United States Patent [19]

Maurer et al.

[11] Patent Number: 4,541,319

[45] Date of Patent: Sep. 17, 1985

[54] COLD MEAT SLICING MACHINE

[75] Inventors: Albrecht Maurer, Balingen; Alois Butz, Geislingen, both of Fed. Rep. of Germany

[73] Assignee: Bizerba-Werke Wilhelm Kraut GmbH & Co. KG, Fed. Rep. of Germany

[21] Appl. No.: 574,675

[22] Filed: Jan. 27, 1984

[30] Foreign Application Priority Data

Feb. 10, 1983 [DE] Fed. Rep. of Germany ..... 3304586

[51] Int. Cl.[4] ..... B26D 7/06; B26D 7/22

[52] U.S. Cl. ..... 83/707; 83/468; 83/DIG. 1

[58] Field of Search ..... 83/707, 713–731, 83/DIG. 1, 399, 400, 467, 468

[56] References Cited

FOREIGN PATENT DOCUMENTS 2749652 5/1979 Fed. Rep. of Germany ... 83/DIG. 1

*Primary Examiner*—James M. Meister

*Attorney, Agent, or Firm*—Leydig, Voit & Mayer

[57] ABSTRACT

The invention relates to a cold meat slicing machine comprising a locking device exhibiting the following features: a slider member articulated at the carriage prevents swivel motion of the carriage at a thickness of cut setting other than zero; a bar is swivable into a first end position in which it permits swivel motion of the carriage; a claw connected to the bar locks the device for adjusting a stop plate at the zero thickness of cut setting; a supporting surface of the slider member locks the adjusting device in the zero position when the carriage is in the swivelled-out position; in the swivelled position of the carriage, rotation of the slider member, and, consequently, alteration of the zero position of the device for adjusting the stop plate are excluded.

7 Claims, 5 Drawing Figures

COLD MEAT SLICING MACHINE

The invention relates to a cold meat slicing machine comprising a machine housing, a rotating circular cutter blade rotatably mounted on the machine housing, a stop plate adjustable relative to the circular cutter blade for setting the thickness of cut, a device for adjusting the stop plate, a carriage, reciprocatable on the housing and swivable away from the housing, for depositing and advancing stock to be sliced, and a locking device which, on the one hand, prevents swivel motion of the carriage when the stop plate is set at a thickness of cut other than zero, and, on the other hand, excludes adjustment of the stop plate set at the zero thickness of cut when the carriage is swivelled.

In a known machine of this kind (German Offenlegungsschrift No. 2 749 652), the reciprocatable carriage is only swivable in one single end position. A slicing machine of the type in question, wherein the carriage can be swivelled out, in every position along its path of displacement, and the device for adjusting the stop plate is simultaneously locked in the zero position, has been indicated, however, the locking device required was composed of numerous parts, some of which subject to spring force and mounted for rotation, which renders the appliance elaborate to manufacture, complicated and susceptible to failure.

The object underlying the invention is to equip a cold meat slicing machine of the pertinent kind with a locking device for the carriage and the stop plate adjusting device, which is of simple design and is unsusceptible to failure.

In order to achieve this object, in accordance with the invention, such a locking device exhibits the following features:

a. a slider member is articulated at the carriage;

b. at a thickness of cut setting other than zero, a stop face of the slider member engages a counter stop member fixedly attached to the carriage and prevents swivel motion of the carriage;

c. a bar extending over the path of displacement of the carriage is swivable about an axis, arranged stationarily in the housing and extending parallel to this path of displacement, between two end positions, namely a first end position in which it is in disengagement with the slider member, and a second end position in which it releases the stop face of the slider member from the counter stop member and permits swivel motion of the carriage;

d. connected to the adjusting device of the stop plate is a pin which, at the zero thickness of cut setting, transfers the bar from its first to its second end position;

e. attached to the bar is a claw which, in the second end position of the bar, engages the device for adjusting the stop plate and locks the latter at the zero thickness of cut setting;

f. disposed on the slider member is a supporting surface which, in the swivelled-out position of the carriage, supports the bar located in its second end position and holds the claw in locking engagement with the device for adjusting the stop plate.

A preferred embodiment of the invention will now be more particularly described with reference to the accompanying drawings, in which.

Figure 1:
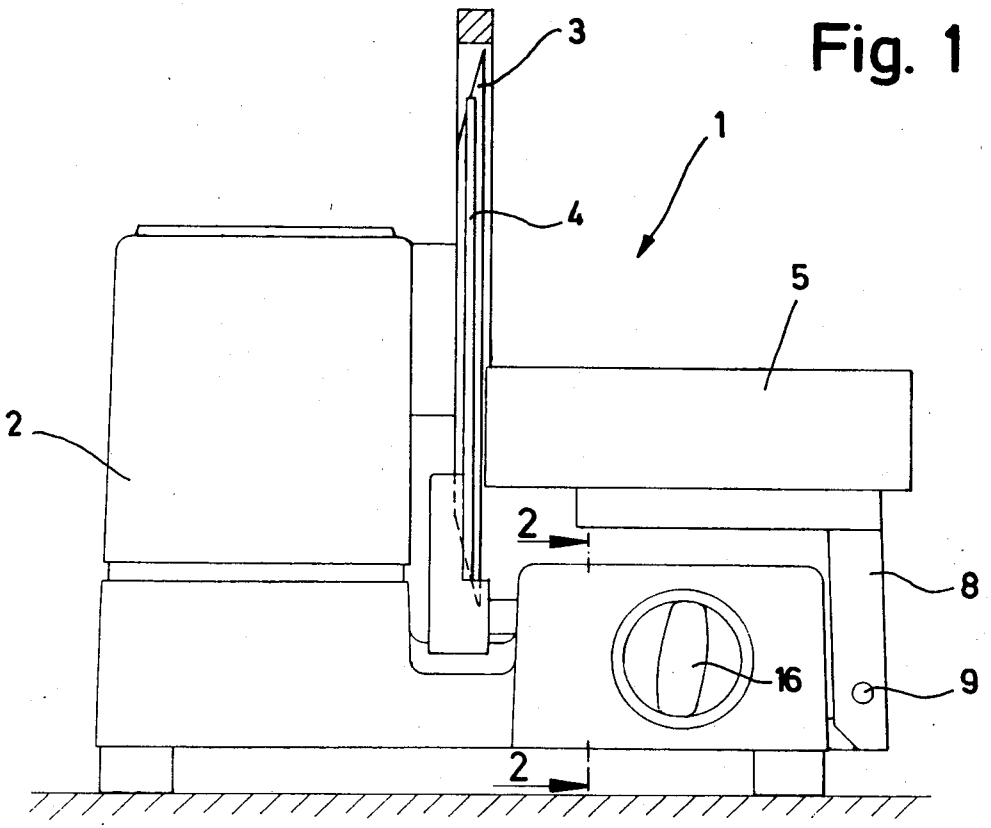
FIG. 1 shows a front view of a cold meat slicing machine.

The cold meat slicing machine 1 shown in the drawings comprises a machine housing 2 with a circular cutter blade 3 rotatably mounted thereon. The circular cutter blade 3 is made to rotate by a motor, not illustrated, which is enclosed by the housing 2. A stop plate 4 extending parallel to the cutting plane of the circular cutter blade 3 is vertically adjustable, in a manner known per se, relative to the circular cutter blade 3. The distance of the stop plate 4 from the circular cutter blade determines the slice thickness or the thickness of cut setting of the machine. The stock to be sliced is placed on a carriage 5 which is slidably displaceable parallel to the cutting plane of the circular cutter blade 3 (perpendicularly to the drawing plane of FIG. 1). The stock to be sliced (not illustrated) is held against the stop plate 4 and advaced, horizontally on the carriage 5, towards the rotating circular cutter blade 3.

Figure 2:
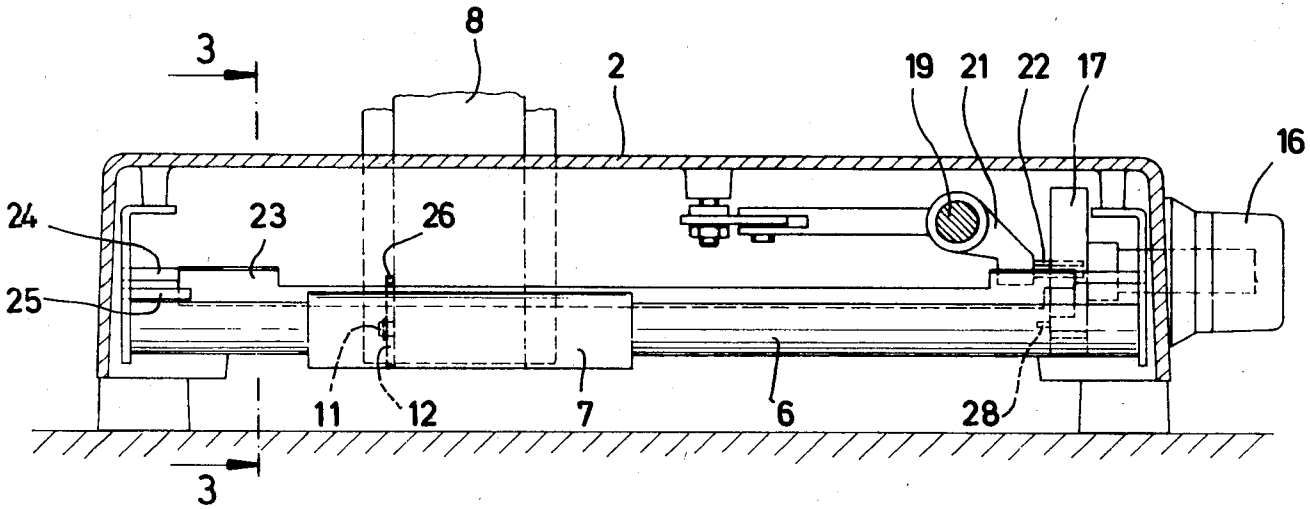
FIG. 2 shows a sectional view taken along line 2—2 of FIG. 1.

Extending rigidly in the machine housing 2, parallel to the direction of displacement of the carriage 5, is a guide axis 6 (FIGS. 2 and 3), with the carriage 5 slidably guided thereon by means of a carriage base 7. The carriage 5 is, furthermore, swivable at a carriage foot member 8 on an axis 9, secured in the carriage base 7, parallel to the guide axis 6, so that it can be swivelled away from the housing 2 in the direction of arrow L for cleaning purposes.

A slider member 12 is articulated at the swivable carriage foot member 8 at an axis 11 extending parallel to the axis 9. The slider member 12 comprises a slotted-link-type recess 13, best visible in FIG. 3, which is engaged by a square peg 14 fixedly attached to the carriage base 7 and acting as counter stop member. In the operating position shown in FIG. 3, the peg 14 engages a stop face 15 of the recess 13, thereby preventing motion of the slider member 12 in the direction of arrow R (FIG. 3) and, consequently, swivel motion of the carriage in the direction of arrow L. In this operating position, the carriage is, therefore, locked in regard to swivel motion away from the housing.

An adjustment device actuated via a turning handle 16 (FIGS. 1 and 2) is provided for setting the stop plate 4 at a desired thickness of cut. When the handle 16 is turned, a disc 17 mounted for rotation within the housing 2 and provided with a helical groove 18 (FIG. 3) is rotated. The stop plate 4 is rigidly connected to an axis 19 which is slidably displaceable in the X direction within the machine housing 2. Protruding from an arm 21 rigidly connected to the axis 19 is a peg 22 which positively engages the helical groove 18. Turning of the disc 17 via the turning handle 16 causes the peg 22, and, consequently, the axis 19 and the stop plate 4 attached to it to be displaced in the direction of arrow X, whereby the distance between stop plate 4 and circular cutter blade 3, i.e., the thickness of cut, is adjustable.

Figure 3:
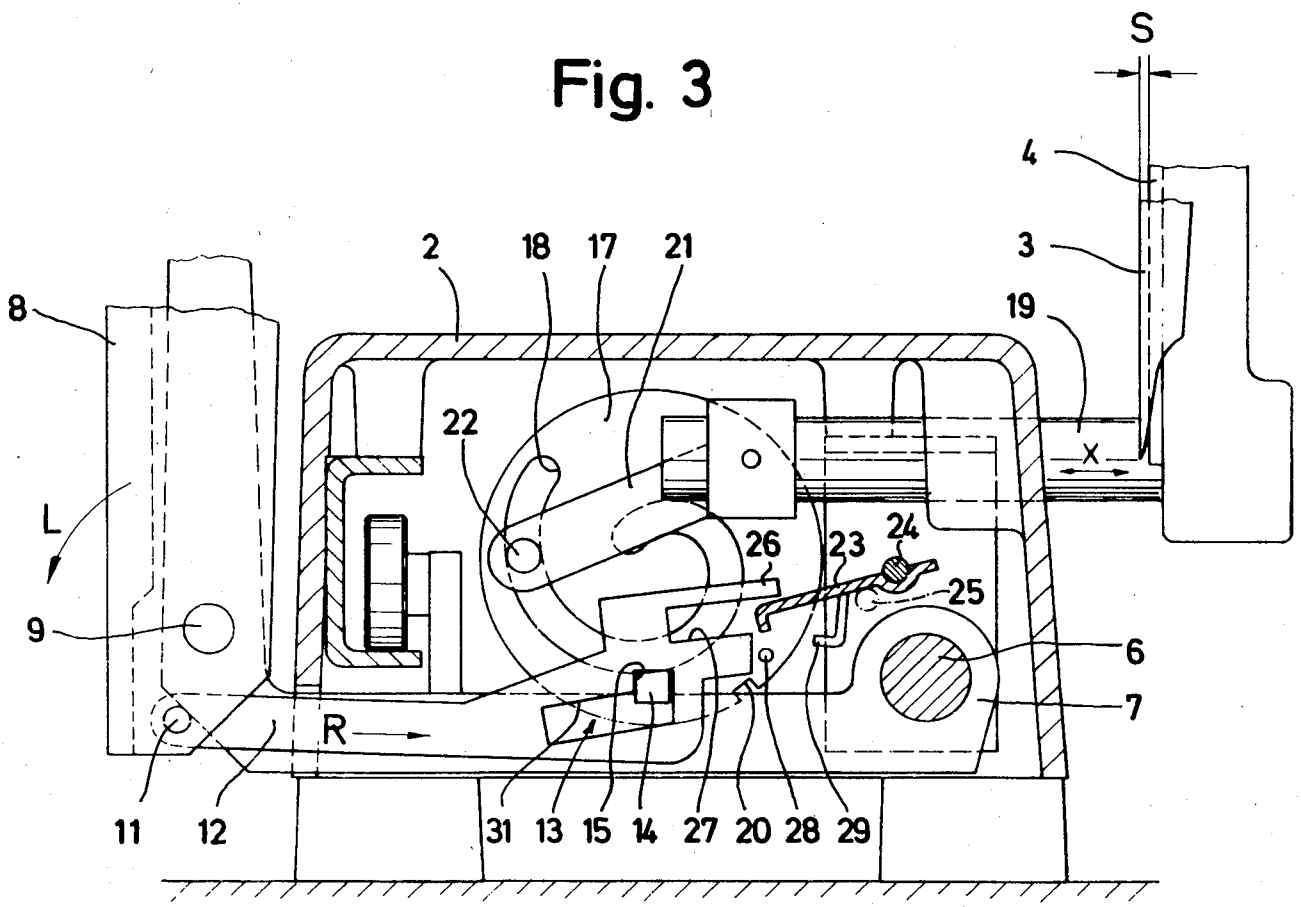
FIG. 3 shows a sectional view taken along line 3—3 of FIG. 2.
Figure 4:
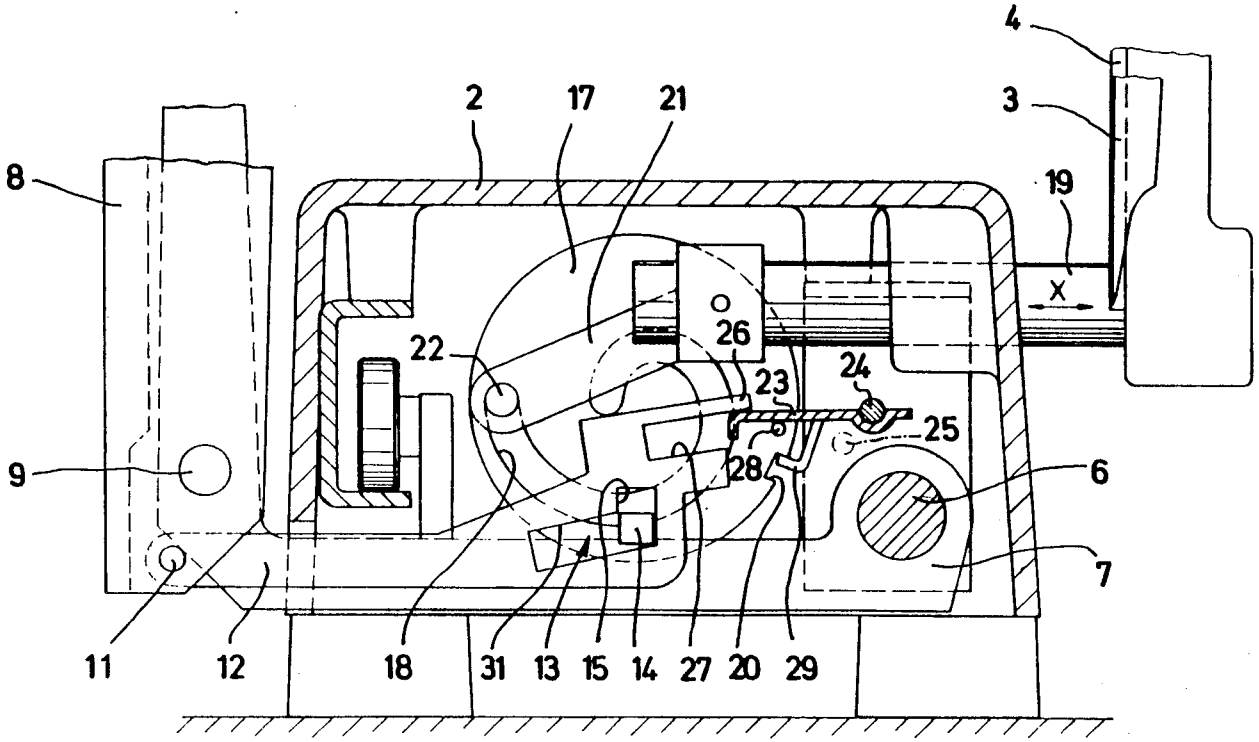
FIG. 4 shows a sectional view, similar to FIG. 3, with the thickness of cut at the zero setting and the carriage in the operating position.
Figure 5:
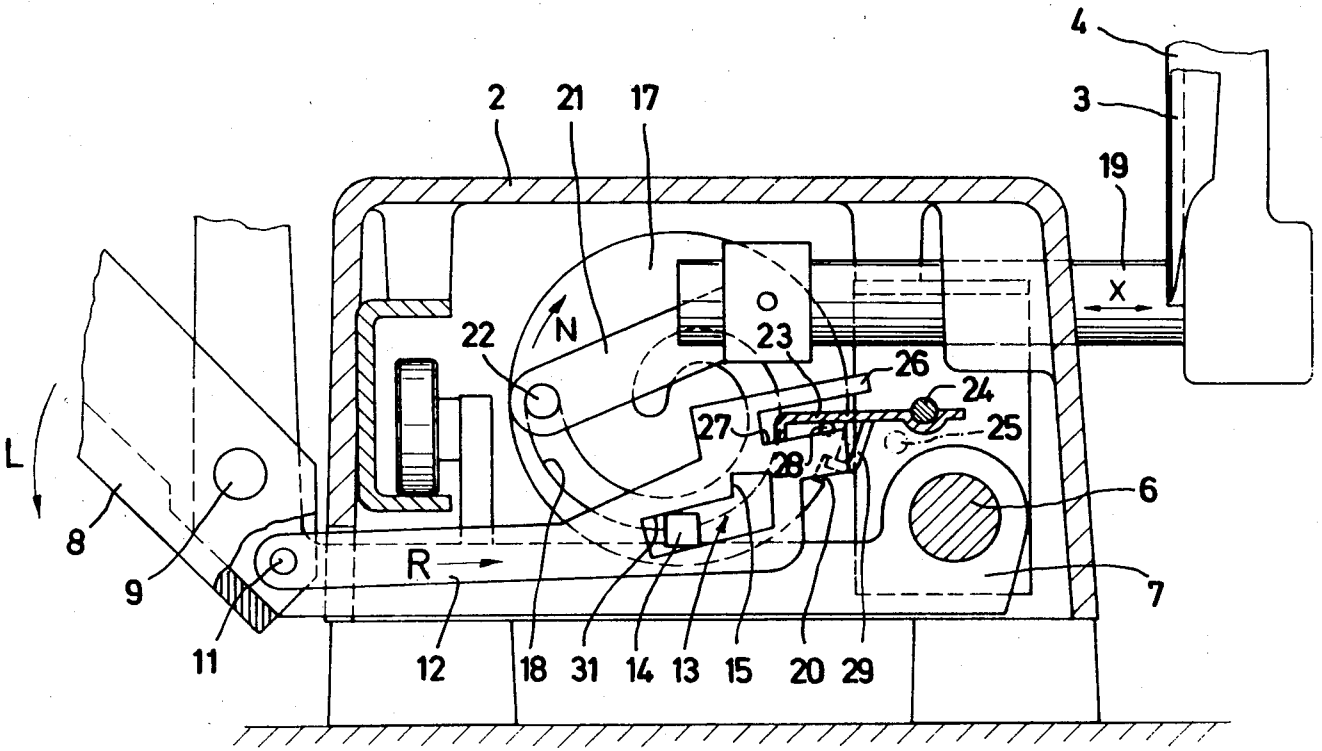
FIG. 5 shows a sectional view, similar to FIG. 4, with the carriage in the swivelled-out position.

In FIG. 3, a thickness of cut S, differing from zero, is set. In FIGS. 4 and 5, the thickness of cut is set at zero. At this thickness of cut setting, the stop plate 4 closely abuts the circular cutter blade 3 and covers it, thereby eliminating the occurrence of injury.

Inside the machine housing 2, a bar 23 is mounted at both end faces, by means of swivel pins 24, for swivel motion in the housing 2. The swivel pins 24 define an axis of rotation stationarily disposed within the housing and extending parallel to the guide axis 6 of the carriage, and, consequently, parallel to its path of displacement. As is apparent from FIG. 2, the bar 23 extends practically over the entire path of displacement of the carriage foot member 8. As shown in FIG. 3, the bar 23 is bent downwardly on its free longitudinal side and engages, in the operating position shown in FIG. 3, a stop pin 25 which holds it in a first end position.

On its free side opposite the articulated axis 11, the slider member 12 is provided with a projection 26 protruding over the bar 23. Beneath the projection 26, the slider member 12 comprises a supporting surface 27. A recess of slotted configuration is disposed between projection 26 and supporting surface 27. The aforementioned slotted-link-type recess 13 in the slider member 12 is comprised of two rectangles and is so dimensioned as to enable, on the one hand, abutment of the square peg 14 with the stop face 15, but, on the other hand, slidable motion thereof in the lower area of the recess 13.

A pin 28 protrudes so far from the disc 17 that upon certain swivel motion of the disc 17 (in the anti-clockwise direction in FIG. 3), it engages the underside of the bar 23 and swivels it about the swivel pins 24 into its second end position shown in FIGS. 4 and 5.

Rigidly connected to the bar 23 is a downwardly extending claw 29. In the second end position of the bar 23, shown in FIGS. 4 and 5, the aforementioned claw automatically engages a recess 20 in the disc 17 and prevents it from rotating. Since the position of the disc 17 as shown in FIGS. 4 and 5 corresponds to the zero thickness of cut setting, the disc 17 is, therefore, automatically locked at this setting. Simultaneously, the bent edge of the bar 23 engages—see FIG. 4—the projection 26 on the slider member 12 and swivels it about the axis 11 until the stop face 15 of the slider member 12 is released from the square peg 14 acting as counter stop member. In this operating position, the carriage can, therefore, be swivelled away from the housing 2 in the direction of arrow L (FIG. 5), and the slider member 12 is displaced on the peg 14 by means of the recess 13.

When the slider member 12 is made to move in the direction of arrow R by the swivelling of the carriage 5 in the direction of arrow L, the free, bent edge of the bar 23 is displaced between projection 26 and supporting surface 27 (to the left in FIGS. 3 to 5), with the aforementioned edge bearing slidingly on the surface 27. This bearing of the bar 23 on the supporting surface 27 of the slider member 12 prevents the bar 23 from swivelling out of the position shown in FIGS. 4 and 5 back into the position illustrated in FIG. 3. Consequently, the claw 29 which is rigidly connected to the bar 23 cannot be moved out of the recess 20 in the disc 17 constituting part of the device for adjusting the stop plate 4, so that this adjusting device is locked when the carriage 5 is in the swivelled-out position. The zero thickness of cut setting is, therefore, unadjustable. The cover plate 4 covers the blade of the circular cutter 3 and prevents the occurrence of injury at this setting.

When the carriage is swivelled back (in the opposite direction of arrow L), the free edge of the bar 23 is released from the supporting surface 27, as shown in FIG. 3, and the adjusting device (disc 17) is now free again to be set at a desired thickness of cut.

In the second end position of the bar 23, shown in FIGS. 4 and 5, the bar, as previously stated, bears on the supporting surface 27. This supporting surface provided on the slider member 12 is stationary in this operating phase because the slider member 12, as shown in FIG. 5, is prevented from downward rotational displacement by the square peg 14 engaging an upper edge 31 of the recess 13, and is only capable of displacement in the direction of arrow R. The claw 29, therefore, remains in the recess 20 of the disc 17, and the disc 17 is prevented from rotation in the direction of the arrow N. Consequently, the stop plate 4 remains in its position covering the circular cutter blade 3.

Since the bar 23 extends over the entire path of displacement of the carriage 5, it bears, in each displacement position of the carriage, on the supporting surface 27. The device (disc 17) for adjusting the stop plate 4 is, therefore, always locked, even when the swivelled-out carriage 5 is displaced on the guide axis 6.

The arrangement described hereinabove may find employment in both cold meat slicing machines with vertically positioned and such with obliquely disposed circular cutter blades.

We claim:

1. Cold meat slicing machine comprising a machine housing, a rotating circular cutter blade rotatably mounted on the machine housing, a stop plate adjustable relative to the circular cutter blade for setting the thickness of cut, a device for adjusting the stop plate, a carriage, reciprocatable on the housing and swivable away from the housing, for depositing and advancing stock to be sliced, and a locking device which, on the one hand, prevents swivel motion of the carriage when the stop plate is set at a thickness of cut other than zero, and, on the other hand, excludes adjustment of the stop plate set at the zero thickness of cut when the carriage is swivelled, characterized by the following features of the locking device:

a. a slider member (12) is articulated at the carriage (5,8);

b. at a thickness of cut setting other than zero, a stop face (15) of the slider member engages a counter stop member (14) fixedly attached to the carriage and prevents swivel motion of the carriage;

c. a bar (23) extending over the path of displacement of the carriage is swivable about an axis (24), arranged stationarily in the housing and extending parallel to this path of displacement, between two end positions, namely a first end position in which it is in disengagement with the slider member, and a second end position in which it releases the stop face of the slider member from the counter stop member and permits swivel motion of the carriage;

d. connected to the adjusting device (16,17) of the stop plate (4) is a pin (28) which, at the zero thickness of cut setting, transfers the bar from its first to its second end position;

e. attached to the bar is a claw (29) which, in the second end position of the bar, engages the device for adjusting the stop plate and locks the latter at the zero thickness of cut setting;

f. disposed on the slider member is a supporting surface (27) which, in the swivelled-out position of the carriage, supports the bar located in its second end position and holds the claw in locking engagement with the device for adjusting the stop plate;

g. the slider member is provided with an edge (31) which is engaged by the counter stop member (14) when the carriage is swivelled.

2. Slicing machine as defined in claim 1, characterized in that the counter stop member (14) is constituted by a peg and is enclosed by a slotted-link-type recess (13) in the slider member (12).

3. Slicing machine as defined in claim 2, characterized in that the peg is a square peg, and the recess (13) is delimited by rectangular edges.

4. Slicing machine as defined in claims 1, 2 or 3, characterized in that the bar (23) is mounted for swivel motion, at both end faces, in swivel pins (24) which are stationarily arranged in the housing.

5. Slicing machine as defined in one of claims 1, 2 or 3, characterized in that the bar (23), in its first end position, engages a stop pin (25).

6. Slicing machine as defined in one of claims 1, 2 or 3, characterized in that the device for adjusting the stop plate (4) comprises a rotatably mounted disc (17), with the pin (28) for transferral of the bar (23) from its first to its second end position, and a recess (20) for accommodation of the claw (29) arranged thereon.

7. Slicing machine as defined in one of claims 1, 2 or 3, characterized in that the slider member (12) comprises a projection (26) for engagement with the bar (23), and in that the supporting surface (27) for the bar is located underneath this projection.

* * * * *